United States Patent [19]

Shimogori et al.

[11] Patent Number: 4,820,486

[45] Date of Patent: Apr. 11, 1989

[54] LOW ALLOY STEEL HAVING GOOD STRESS CORROSION CRACKING RESISTANCE

[75] Inventors: Kazutoshi Shimogori; Kazuo Fujiwara, both of Kobe; Kiyoshi Sugie, Akashi; Kikuo Morita, Kakogawa; Takenori Nakayama, Kobe; Mutsuhiro Miyakawa; Yasushi Torii, both of Kakogawa, all of Japan

[73] Assignee: Kabushiki Kaisha Kobe Seiko Sho, Kobe, Japan

[21] Appl. No.: 846,102

[22] Filed: Mar. 31, 1986

[30] Foreign Application Priority Data

Apr. 5, 1985 [JP] Japan ..... 60-73368
Nov. 6, 1985 [JP] Japan ..... 60-249707

[51] Int. Cl.[4] ..... C22C 38/44

[52] U.S. Cl. ..... 420/108; 420/106; 420/109

[58] Field of Search ..... 148/36, 33 S; 75/128 W; 420/106, 108, 109

[56] References Cited

U.S. PATENT DOCUMENTS

| | | | |
|---|---|---|---|
| 3,266,947 | 8/1966 | Steiner | 148/36 |
| 3,438,822 | 4/1969 | Allen | 148/36 |
| 4,185,998 | 1/1980 | Reisdorf | 148/36 |
| 4,214,950 | 7/1980 | Balandin et al. | 75/128 W |
| 4,322,256 | 3/1982 | Henning | 148/36 |
| 4,741,880 | 5/1988 | Lang et al. | 420/109 |

FOREIGN PATENT DOCUMENTS

| | | |
|---|---|---|
| 39-22482 | 10/1964 | Japan . |
| 41-1601 | 4/1966 | Japan . |
| 47-25248 | 7/1972 | Japan . |
| 50-5217 | 1/1975 | Japan . |
| 53-30915 | 3/1978 | Japan . |
| 53-78914 | 7/1978 | Japan . |
| 53-112220 | 9/1978 | Japan . |
| 54-145318 | 11/1979 | Japan . |
| 55-8486 | 1/1980 | Japan . |
| 58-45360 | 3/1983 | Japan . |

*Primary Examiner*—Deborah Yee
*Attorney, Agent, or Firm*—Oblon, Fisher, Spivak, McClelland & Maier

[57] ABSTRACT

The present invention relates to low alloy steel and specifically to nickel-chrome-molybdenum steel.

A low alloy steel having excellent stress corrosion cracking resistance containing C:≦0.40%, Si:≦0.15%, Mn:≦0.20%, P:≦0.010%, S:≦0.030%, Ni: 0.50 to 4.00%, Cr: 0.50 to 2.50%, Mo: 0.25 to 4.00% and V:≦0.30%, said Si, Mn and P being fulfilled with relationship of Si+Mn+20P≦0.30%, the remainder comprising Fe and unavoidable impurities, the prior austenite crystal grain size being in excess of 4 of ASTM crystal grain size number.

2 Claims, 2 Drawing Sheets

LOW ALLOY STEEL HAVING GOOD STRESS CORROSION CRACKING RESISTANCE

BACKGROUND OF THE INVENTION

1. Field of the Invention

The present invention relates to low alloy steel used as a material for steam turbines or the like, and more specifically to nickel-chrome-molybdenum steel.

2. Description of the Prior Art

Generally, for materials used for steam turbines driven by water vapor having a high temperature and a high pressure (approximately 300° C. and 70 kg/cm$^2$), excellent strength and toughness over a wide range of temperatures are required, and nickel-chrome-molybdenum steel to which vanadium is added, which is high strength steel, is used as a material to meet th aforesaid characteristic. This steel is obtained by adding molybdenum or vanadium which is a fine carbide deposited element to nickel-chrome high strength steel sensitive to temper embrittlement as is known whereby increasing a restraint of softening, that is, a tempering resistance at a high tempering temperature. This steel is well suited for the above-described applications.

It has been however recently revealed that stress corrosion cracking are frequently encountered in low pressure steam turbines and peripheral equipment which are nickel-chrome-molybdenum steel with vanadium added thereto mainly in the United States and European nuclear power stations, which poses a significant problem. This stress corrosion cracking occurs mainly in a key way at which a disk and a shaft are secured together and in a joint between a blade and a disk. It is said that Na in the form of impurities in vapor is concentrated as NaOH in crevices of such portions as described above to form a crack along a grain boundary along with the presence of a high load stress when the turbine is operated. It has been also known that intergranular stress corrosion cracking occurred in carbon steel subjected to stress and to the environment containing OH. In view of the foregoing, it has been earnestly desired to develop nickel-chrome-molybdenum steel having excellent stress corrosion cracking resistance even under the severe using environment.

DETAILED DESCRIPTION OF THE INVENTION

Figure 1:
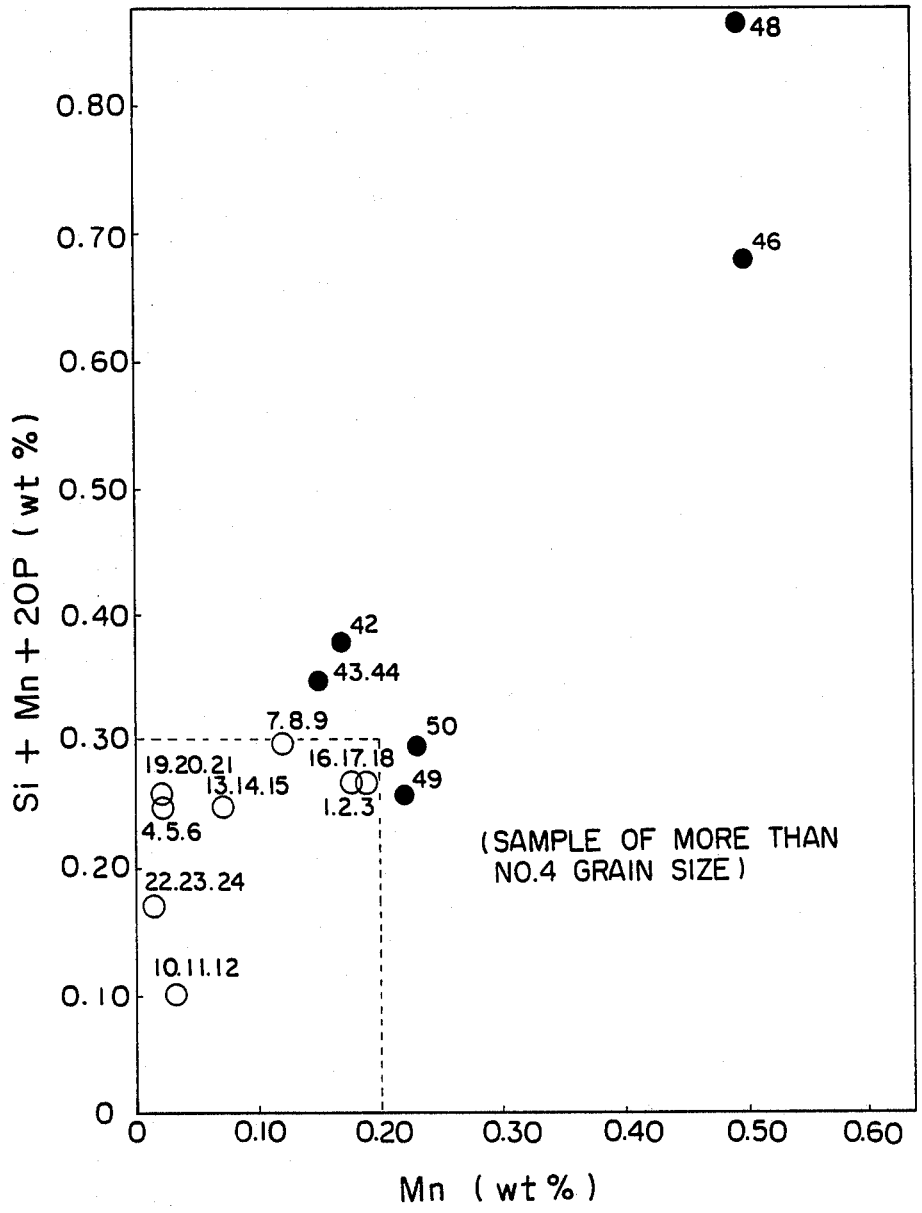

It is therefore an object of the present invention to provide a steel with a proper alloy-composition, microalloying element and/or microstructure which lowers sensitiveness to stress corrosion cracking, and capable of being used without cracking even under the severe environment.

In order to clarify the condition of a combination of the stress corrosion cracking sensitivity of nickel-chrome-molybdenum steel and alloy-composition, microalloying element and microstructure, sample steels with the aforesaid various factors varied were subjected to testing of stress corrosion cracking and the test results thereof were analyzed in detail to obtain the present invention. NiCrMo steel having excellent stress corrosive cracking resistance are as follows:

(1) A low alloy steel having good stress corrosion cracking resistance containing C:≦0.40%, Si:≦0.15%, Mn:≦0.20%, P:≦0.010%, S:≦0.030%, Ni: 0.50 to 4.00%, Cr: 0.50 to 2.50%, Mo: 0.25 to 4.00% and V:≦0.30%, said Si, Mn and P being fulfilled with relationship to Si+Mn+20P≦0.30%, the remainder comprising Fe and unavoidable impurities, the austenite crystal grain size thereof being in excess of 4 of ASTM crystal grain size number.

(2) A low alloy steel having good stress corrosion cracking resistance containing C:≦0.40%, Si:≦0.15%, Mn:≦0.60%, P:≦0.010%, S:≦0.030%, Ni: 0.50 to 4.00%, Cr: 0.50 to 2.50%, Mo: 0.25 to 4.00% and V:≦0.30% and further containing at least one of the kind selected from the following groups (i) and (ii):

(i) At least one kind of Al, Ti, Nb, W, B and Ce: 0.001 to 0.50% in total (ii) Sn: 0.003 to 0.015% said Si, Mn and P being fulfilled with the relationship of Si+Mn+20P≦0.75%, the remainder comprising Fe and unavoidable impurities.

(3) A low alloy steel having good stress corrosion cracking resistance containing C:≦0.40%, Si:≦0.15%, MN:≦0.50%, P:≦0.010%, S:≦0.030%, Ni: 0.50 to 4.00%, Cr: 0.50 to 2.50%, Mo: 0.25 to 4.00% and V:≦0.30% and further containing at least one kind selected from the following (i) and (ii) groups:

(i) At least one kind of Al, Ti, Nb, W, B and Ce: 0.001 to 0.50% in total (ii) Sn: 0.003 to 0.015% the remainder comprising Fe and unavoidable impurities, the austenite crystal grain size thereof being in excess of 4 of ASTM crystal grain size number.

(4) A low alloy steel having good stress corrosion craking resistance containing C:≦0.04%, Si: ≦0.15%, Mn:≦0.60%, P:≦0.010%, Si:≦0.030%, Ni: 0.50 to 4.00%, Cr: 0.50 to 2.50%, Mo: 0.25 to 4.00% and V:≦0.30% and further containing at least one kind selected from the following groups (i) and (ii):

(i) At least one kind of Al, Ti, Nb, W, B and Ce: 0.001 to 0.50% in total (ii) Sn: 0.003 to 0.15% said Si, Mn and P being fulfilled with the relationship of Si+Mn+20P≦0.75%, the remainder comprising Fe and unavoidable impurities, the austenite crystal grain size thereof being in excess of 4 of ASTM crystal grain size number.

(5) A low steel as set forth in (2) or (4) above in which Si, Mn and P are in the relationship of Si+Mn+20P≦0.50%.

In the following, the reasons for limiting chemical components and ASTM crystal grain size number of the present invention will be described.

C is an element for securing the strength. However, this element increases the sensitivity of stress corrosion cracking, and when its content exceeds 0.4%, toughness is deteriorated in relation to other alloy elements. Therefore, in claims, the upper limit is set to 0.40%.

S is an element which greatly deteriorates hot processing characteristics, and in view of preventing cracking during hot forging, the upper limit is set to 0.030% in claims.

Ni and Cr are elements indispensable to an increase in strength, an improvement of hardenability and an enhancement in toughness. Both the elements have to be added in the amount in excess of 50%. Preferably, Ni and Cr should be added in the amount in excess of 3.25% and 1.25%, respectively, in order to win further improvement of hardenability and toughness. When the contents of said elements exceeds 4.00% and 2.50%, respectively, the transformation characteristics are greatly varied, and it takes a long time for heat treatment to obtain an excellent toughness, which is therefore impractical. Thereby, in claims, the Ni content and Cr content are limited in the range of (6) A low alloy steel as set forth in (1) to (5) above, wherein Ni:3.25 to 4.00% and Cr:1.25 to 2.00%

(7) A low alloy steel having good stress corrosion cracking resistance containing C:≦0.40%, SI:≦0.15%, Mn:≦0.60%, P:≦0.010%, S:≦0.030%, Ni:3.25 to 4.00%, Cr: 1.25 to 2.00%, Mo: 0.25 to 4.00%, V:≦0.30% and Nb:0.005 to 0.50%, said Si, Mn and P being fulfilled with the relationship of Si+Mn+20P≦0.50%, the remainder comprising Fe and unavoidable impurities. 0.50 to 4.00% and 0.50 to 2.50%, respectively, in (1) to (5) above, and 3.25 to 4.00% and 1.25 to 2.5%. respectively, in (6) and (7) above, Mo enhances the corrosion resistance of the γ grain boundary to materially reduce the sensitivity of intergranular stress corrosion cracking, is deposited in grains as a fine carbide during the tempering and greatly contributes to prevention of temper embrittlement and increase in strength. In order to obtain such effects, more than 0.25% of Mo need to added but when the content thereof exceeds 4.00%, the aforesaid effects are saturated and the toughness begins to deteriorate. Furthermore, addition of Mo more than as needed is uneconomical. Thereby, in claims, the Mo content is limited to the range of 0.25% to 4.00%.

V is an effective element in which strength of steel is increased by formation of fine crystals and precipitation hardening. V is added as necessary but when the content thereof exceeds 0.30%, the effect thereof is saturated, and therefore, in claims, the upper limit is set to 0.30%.

Si, P and Mn are greatly concerned in the sensitivity of intergranular stress corrosion cracking. They are important elements which should be complementarily limited in relation to the size of crystal grain and a small addition of Ti, Al, Nb, W, B, Ce and Sn.

Si is an element necessary for deoxidation during refining. When the content of Si exceeds 0.15%, the corrosion resistance of the γ grain boundary deteriorates and the sensitivity of intergranular stress corrosion cracking materially increases. Therefore, in claims, the upper limit of Si is set to 0.15%.

P is an impurity element which is segregated in the γ grain boundary to deteriorate the corrosion resistance and increase the sensitivity of intergranular stress corrosion cracking and promote temper embrittlement. In chrome-molybdenum steel and nickel-chrome-molybdenum steel in the JIS Standards, the content thereof is limited to 0.030% or less in view of temper embrittlement. However, in order to reduce the stress corrosion cracking, said content is necessary to be further limited, and in claims 1 to 5, the content of P is set to 0.010% or less.

Mn is added for deoxidation and desulfurization during refining. When the content of Mn exceeds 0.205, the aforesaid segregation of grain boundary is promoted and the sensitivity of stress corrosion cracking materially increases, and in addition, Si and P compositely acts on the stress corrosion cracking and the range of application thereof is greatly concerned in the size of crystal grains and the small addition of Ti, Al, Nb, W, B, Ce and Sn, as was made apparent from the results of the inventor's own studies. That is, it is necessary, in terms of prevention of stress corrosion cracking in claim 1 wherein the small addition of Ti, Al, Nb, W, B, Ce and Sn is not effected, to limit the content of Mn to the range of 0.20% or less, and to strictly limit the contents so that the contents of Si, P and Mn fulfill the relationship of (Mn+Si+20P)≦0.30%, that is, the total of the weight % of contained Mn, the weight % of contained Si and 20 times of weight % of contained P is less than 0.30 %. On the other hand, it has been found from the detailed study of the influence of the microstructure in an attempt to further enhancing the reliability of sensitivity of stress corrosion cracking that the sensitivity of stress corrosion cracking also depend on the austenite crystal grain size, and sufficient reliability cannot be obtained even if the aforesaid alloy composition should be satisfied when the ASTM crystal grain size number is smaller than 3. Accordingly, in claim 1 of the present invention, the austenite crystal grain size number is limited to above 4 in addition to the limitation of the aforesaid alloy elements.

The proper range of Mn content and/or Si+Mn+20P in claims 2 to 5 is different from the case of claim 1. This results from the fact that the sensitivity of stress corrosion cracking is greatly related to the size of crystal grains and containment of small addition elements of Ti, Al, Nb, W, B, Ce and Sn. It is possible to further enhance the reliability of the sensitivity of stress corrosion cracking by a proper combination of these various conditions.

Al, Ti, Nb, Ce, W, B and Sn are addition elements indispensable to enhancement of corrosion resistance of the γ grain boundary and great contribution to reducing the sensitivity of stress corrosion cracking of the grain boundary type. In order to obtain such effects, in these six elements, i.e, Al, Ti, Nb, Ce, W and B, more than one kind of these elements need be added in the amount of 0.001% or more in total. Among them Nb addition set to 0.5% or more is the most effective to reduce the stress corrosion cracking, relating to the limitations of Si+Mn+20P≦0.50%. However, when the total of addition exceeds 0.50%, the toughness is materially deteriorated. Thereby, the total amount of addition of these elements is limited to the range of 0.001 to 0.50%. On the other hand, in case of Sn, similar effect to the addition of the aforesaid six elements may be obtained by addition of more than 0.003% of Sn but when the content thereof exceeds 0.015%, the temper embrittlement is increased to materially deteriorate the toughness. Thereby, the content of Sn is limited to the range of 0.003 to 0.015%. In order to reduction in stress corrosion cracking, however, the microalloying element addition, limitation of Mn content and/or range of Si+Mn+20P or limitation of size of crystal grains are necessary. That is, it is necessary to fulfill either condition that Mn≦0.60% and Si+Mn+20P≦0.75%, and that the size of the austenite crystal grain is above 4 of ASTM crystal grain number. The former condition and latter condition correspond to required conditions of claims 2 and 3, respectively. It has been found that if both the conditions are simultaneously fulfilled, the excellent stress corrosion cracking properties superior to those of claims 2 and 3 may be obtained. Thus, this requirement is defined in claim 4. It has been further found as the result of detailed studies that by the provision of Si+Mn+20P≦0.50%, further reliability relative to the reduction in stress corrosion cracking not obtained in claims 2 and 4 while fulfilling the requirements of claims 2 and 4. Thus, this is defined in claim 5.

NiCrMo steel according to the present invention contains optimum alloy elements having the excellent stress corrosion cracking resistance in the range of an optimum composition ratio and or has an appropriate microstructure (crystal grain size), and therefore, even if said steel is used for members subjected to a high load stress under the corrosion environment such as NaOH, $OH^-$ or the like, there is less possibility in producing stress corrosion cracking.

EXAMPLE 1

The effectiveness of claim 1 of the present invention will be described hereinafter by way of Examples.

Table 1 appearing later gives chemical compositions of sample steel used for stress corrosion cracking test and the γ crystal grain size. These steels were produced by adjusting compositions and melting them in a high frequency induction electric furnace, thereafter making ingots, hot forging them into 25 mm thickness, heating them to a temperature of forming austenite and water quenching them, thereafter heating them up to 620° C. and holding them for one hour and then cooling them at a speed of 4° C./min. The crystal grain size was varied by adjusting the quenching temperature (heating temperature) and its holding time. The thus produced sample steel was machined to produce a strip of testpiece of 1.5 mm thickness×15 mm width×65 mm length.

Figure 2:
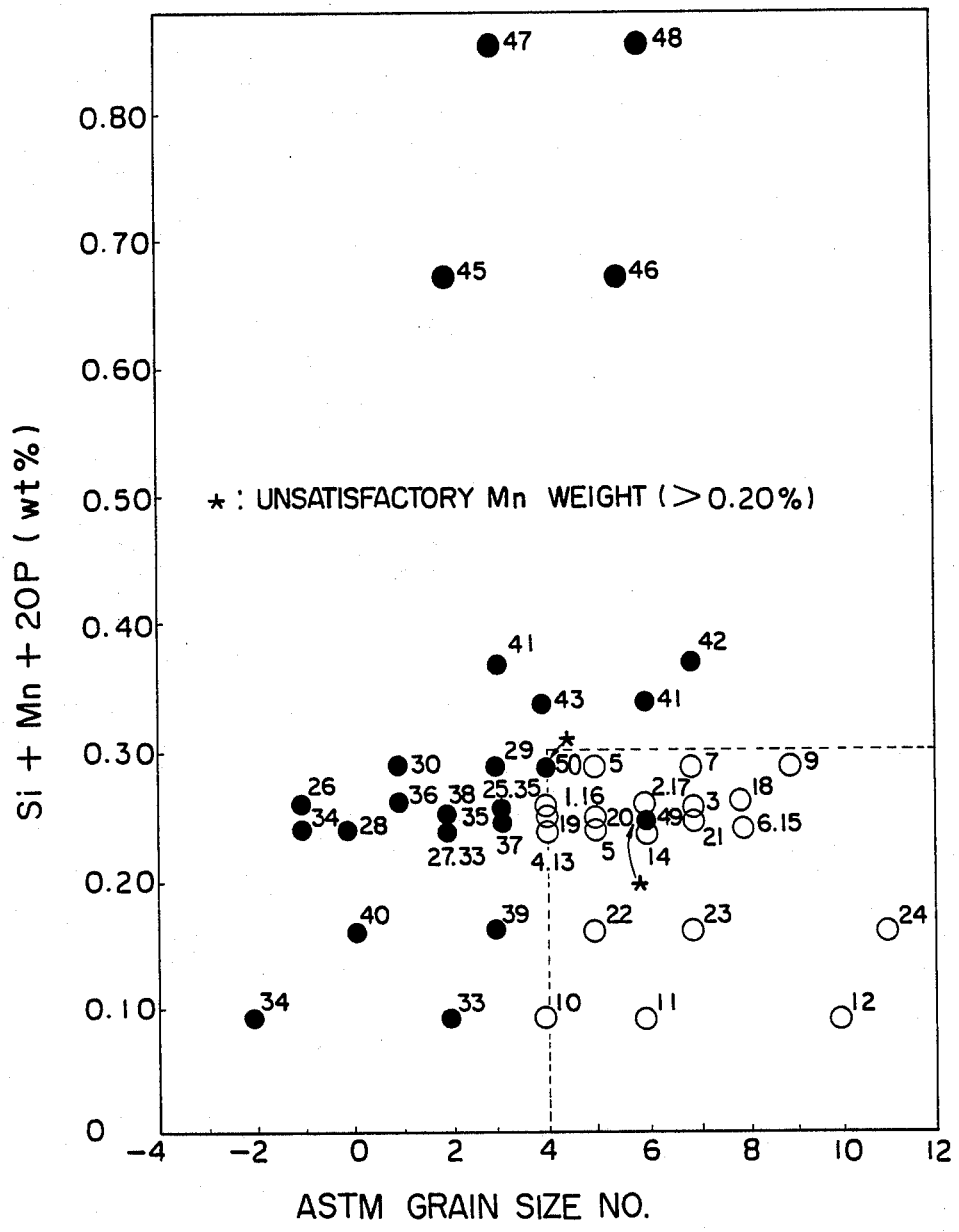

In the stress corrosion cracking test, the aforesaid testpiece was attached to a four-point bending constant load testing apparatus, bending stress corresponding to 60% of 0.2% proof stress of the steel was applied thereto, the testpiece was immersed in 30% NaOH aqueous solution at 150° C. for one week, and thereafter the presence of cracking and the depth of cracking of the testpiece were measured by observation of an optical microscope. The results of the aforesaid stress corrosion cracking test are shown in Table 1, and FIGS. 1 and 2. As will be apparent from the Table and the figures, the steels (Nos. 1 to 24) according to the present invention have no stress corrosion cracking therein. On the other hand, comparative steels (Nos. 25 to 50) outside the claims have the stress corrosion cracking of the grain boundary type. Particularly, as will be seen from FIGS. 1 and 2, it is evident that no stress corrosion cracking is produced by the provision of $Mn \leqq 0.20\%$, $Si+Mn+20P \leqq 0.30\%$, and ASTM grain size number in excess of 4. It is found from these facts that the limitation of Mn, Si and amount of P, the limitation of amount of (Mn+Si+20P) and the limitation of crystal grain size are very effective in prevention of stress corrosion cracking.

EXAMPLE 2

Next, the effectiveness of claims 2 to 5 of the present invention will be described in detail.

Table 3 appearing later gives chemical composition of sample steel used for stress corrosion cracking test and the γ crystal grain size. Similarly to Example 1, these steels were produced by adjusting compositions and melting them in a high frequency induction electric furnace, thereafter making ingots, hot forging them into 25 mm thickness, heating them to a temperature of forming austenite and water quenching them, thereafter heating them up to 620° C. and holding them for one hour and them cooling them at a speed of 4° C./min. The crystal grain size was varied by adjusting the quenching temperature (heating temperature) and its holding time. The thus produced sample steel was machined to produce a strip of testpiece of 1.5 mm thickness×15 mm width×65 mm length.

In the stress corrosion cracking test, the aforesaid testpiece was attached to a four-point bending constant load testing apparatus, bending stress corresponding to 60% or 100% of 0.2% proof stress of the steel was applied thereto, the testpiece was immersed in 30% NaOH aqueous solution at 150° C. for one week or three weeks, and thereafter the presence of cracking and the depth of cracking of the testpiece were measured by observation of an optical microscope.

The results of the above-described test are shown in Table 3.

As will be apparent from the test results, the steels (Nos. 51 to 94) according to the present invention corresponding to claims 2 and 3 including claims 4 and 5 have no stress corrosion cracking. On the other hand, comparative steels (Nos. 95 to 109) outside the claims have the intergranular stress corrosion cracking. It is found from the aforesaid facts that the limitation of Mn, Si and amount of P, the limitation of amount of (Mn+Si+20P) or the limitation of the crystal grain size toward of which the present invention intends are very effective in prevention of stress corrosion cracking.

On the other hand, even in Test II which made severe of the condition in Test I in terms of stress, steels (Nos. 66 to 87) corresponding to claims 4 and 5 have no stress corrosion cracking, and it is found that simultaneous performance of the limitation of Mn+Si+20P amount and the limitation of crystal grain size leads to a further increase in reliability of stress corrosion cracking.

Moreover, in Test III which has the most severe testing conditions, only steels corresponding to Nos. 85 to 94, that is, those which are fulfilled with $Si+Mn+20P \leqq 0.50$ and ASTM crystal grain size number in excess of 4 have no stress corrosion cracking. That is, it is evident that the aforementioned condition is the most effective limitation in prevention of stress corrosion craking that may be achieved by the present invention.

TABLE 1

| Test steel No. | Chemical component (Weight %) C | Si | Mn | P | S | Ni | Cr | Mo | V | Mn + Si + 20P (Weight %) | Prior γ Grain size | Classification | Remarks |
|---|---|---|---|---|---|---|---|---|---|---|---|---|---|
| 1 | 0.23 | 0.04 | 0.18 | 0.002 | 0.009 | 3.54 | 1.66 | 0.33 | 0.10 | 0.26 | 4 | Invention steel | |
| 2 | " | " | " | " | " | " | " | " | " | " | 6 | " | |
| 3 | " | " | " | " | " | " | " | " | " | " | 7 | " | |
| 4 | 0.21 | 0.14 | 0.02 | 0.004 | 0.012 | 3.49 | 1.57 | 0.34 | " | 0.24 | 4 | " | |
| 5 | " | " | " | " | " | " | " | " | " | " | 5 | " | |
| 6 | " | " | " | " | " | " | " | " | " | " | 8 | " | |
| 7 | 0.20 | 0.03 | 0.12 | 0.007 | 0.005 | 3.53 | 1.62 | 0.33 | 0.11 | 0.29 | 5 | " | |
| 8 | " | " | " | " | " | " | " | " | " | " | 7 | " | |
| 9 | " | " | " | " | " | " | " | " | " | " | 9 | " | |
| 10 | " | 0.04 | 0.03 | 0.001 | 0.002 | 3.56 | 1.69 | 0.32 | 0.12 | 0.09 | 4 | " | |
| 11 | " | " | " | " | " | " | " | " | " | " | 6 | " | |
| 12 | " | " | " | " | " | " | " | " | " | " | 10 | " | |

TABLE 1-continued

| Test steel No. | Chemical component (Weight %) C | Si | Mn | P | S | Ni | Cr | Mo | V | Mn + Si + 20P (Weight %) | Prior γ Grain size | Classification | Remarks |
|---|---|---|---|---|---|---|---|---|---|---|---|---|---|
| 13 | 0.23 | 0.05 | 0.07 | 0.006 | 0.006 | 3.53 | 1.62 | 0.35 | 0.09 | 0.24 | 4 | " | |
| 14 | " | " | " | " | " | " | " | " | " | " | 6 | " | |
| 15 | " | " | " | " | " | " | " | " | " | " | 8 | " | |
| 16 | 0.21 | 0.04 | 0.19 | 0.003 | 0.007 | 3.54 | " | 0.30 | 0.10 | 0.26 | 4 | " | |
| 17 | " | " | " | " | " | " | " | " | " | " | 6 | " | |
| 18 | " | " | " | " | " | " | " | " | " | " | 8 | " | |
| 19 | 0.22 | 0.03 | 0.02 | 0.010 | 0.003 | 3.52 | 1.58 | 0.32 | 0.11 | 0.25 | 4 | " | |
| 20 | " | " | " | " | " | " | " | " | " | " | 5 | " | |
| 21 | " | " | " | " | " | " | " | " | " | " | 7 | " | |
| 22 | " | 0.04 | 0.01 | 0.005 | 0.004 | 3.53 | 1.62 | 0.34 | 0.10 | 0.16 | 5 | " | |
| 23 | " | " | " | " | " | " | " | " | " | " | 7 | " | |
| 24 | " | " | " | " | " | " | " | " | " | " | 11 | " | |
| 25 | 0.23 | " | 0.18 | 0.002 | 0.009 | 3.54 | 1.66 | 0.33 | " | 0.26 | 3* | Reference steel | Same steel with No. 1~3 |
| 26 | " | " | " | " | " | " | " | " | " | " | 1* | " | Same steel with No. 1~3 |
| 27 | 0.2 | 0.14 | 0.02 | 0.004 | 0.012 | 3.49 | 1.57 | 0.34 | " | 0.24 | 2* | " | Same steel with No. 4~6 |
| 28 | " | " | " | " | " | " | " | " | " | " | 0* | " | Same steel with No. 4~6 |
| 29 | 0.20 | 0.03 | 0.12 | 0.007 | 0.005 | 3.53 | 1.62 | 0.33 | 0.11 | 0.29 | 3* | " | Same steel with No. 7~9 |
| 30 | " | " | " | " | " | " | " | " | " | " | 1* | " | Same steel with No. 7~9 |
| 31 | " | 0.04 | 0.03 | 0.001 | 0.002 | 3.56 | 1.69 | 0.32 | 0.12 | 0.09 | 2" | " | Same steel with No. 10~12 |
| 32 | " | " | " | " | " | " | " | " | " | " | −2* | " | Same steel with No. 10~12 |
| 33 | 0.23 | 0.05 | 0.07 | 0.006 | 0.006 | 3.53 | 1.62 | 0.35 | 0.09 | 0.24 | 2* | " | Same steel with No. 13~15 |
| 34 | " | " | " | " | " | " | " | " | " | " | −1* | " | Same steel with No. 13~15 |
| 35 | 0.21 | 0.04 | 0.19 | 0.003 | 0.007 | 3.54 | 1.62 | 0.30 | 0.10 | 0.26 | 3* | " | Same steel with No. 16~18 |
| 36 | " | " | " | " | " | " | " | " | " | " | 1* | " | Same steel with No. 16~18 |
| 37 | 0.22 | 0.03 | 0.02 | 0.010 | 0.003 | 3.52 | 1.58 | 0.32 | 0.11 | 0.25 | 3* | " | Same steel with No. 19~21 |
| 38 | " | " | " | " | " | " | " | " | " | " | 2* | " | Same steel with No. 19~21 |
| 39 | " | 0.04 | 0.10 | 0.005 | 0.004 | 3.53 | 1.62 | 0.34 | 0.10 | 0.16 | 3* | " | Same steel with No. 22~24 |
| 40 | " | " | " | " | " | " | " | " | " | " | 0* | " | Same steel with No. 22~24 |
| 41 | 0.23 | 0.08 | 0.17 | 0.006 | 0.005 | 3.60 | 1.70 | 0.37 | 0.13 | 0.37* | 3* | " | |
| 42 | " | " | " | " | " | " | " | " | " | " | 7* | " | |
| 43 | 0.22 | 0.07 | 0.15 | " | 0.006 | 3.47 | 1.62 | 0.38 | 0.12 | 0.34* | 4 | " | |
| 44 | " | " | " | " | " | " | " | " | " | " | 6 | " | |
| 45 | 0.23 | 0.02 | 0.50* | 0.008 | 0.003 | 3.68 | 1.72 | 0.36 | 0.10 | 0.68* | 2* | " | |
| 46 | " | " | " | " | " | " | " | " | " | " | 5 | " | |
| 47 | 0.21 | 0.16* | 0.49 | 0.011* | 0.004 | 3.42 | 1.70 | 0.38 | 0.10 | 0.87* | 3* | " | |
| 48 | " | " | " | " | " | " | " | " | " | " | 6 | " | |
| 49 | 0.20 | 0.01 | 0.22* | 0.001 | 0.007 | 3.49 | 1.72 | 0.39 | 0.10 | 0.25 | 5 | * | |
| 50 | " | 0.02 | 0.23* | 0.002 | 0.008 | 3.50 | 1.68 | 0.35 | 0.11 | 0.29 | 4 | " | |

*Beyond the scope of claim

TABLE 2

| Test steel No. | Resistance to stress corrosion cracking property: Occurence of cracking | Depth of crack (mm) | Classification | Remarks | Test steel No. | Resistance to stress corrosion cracking property: Occurence of cracking | Depth of crack (mm) | Classification | Remarks |
|---|---|---|---|---|---|---|---|---|---|
| 1 | No cracking | 0.00 | Invention steel | | 26 | Cracking | 0.18 | Reference steel | Unsatisfactory grain size |
| 2 | No cracking | 0.00 | Invention steel | | 27 | Cracking | 0.13 | Reference steel | Unsatisfactory grain size |
| 3 | No cracking | 0.00 | Invention steel | | 28 | Cracking | 0.20 | Reference steel | Unsatisfactory grain size |
| 4 | No cracking | 0.00 | Invention steel | | 29 | Cracking | 0.02 | Reference steel | Unsatisfactory grain size |
| 5 | No cracking | 0.00 | Invention steel | | 30 | Cracking | 0.11 | Reference steel | Unsatisfactory grain size |
| 6 | No cracking | 0.00 | Invention steel | | 31 | Cracking | 0.08 | Reference steel | Unsatisfactory grain size |
| 7 | No | 0.00 | Invention | | 32 | Cracking | 0.30 | Reference | Unsatisfactory grain size |

TABLE 2-continued

| Test steel No. | Resistance to stress corrosion cracking property: Occurence of cracking | Depth of crack (mm) | Classification | Remarks | Test steel No. | Resistance to stress corrosion cracking property: Occurence of cracking | Depth of crack (mm) | Classification | Remarks |
|---|---|---|---|---|---|---|---|---|---|
| | cracking | | steel | | | | | steel | |
| 8 | No cracking | 0.00 | Invention steel | | 33' | Cracking | 0.09 | Reference steel | Unsatisfactory grain size |
| 9 | No cracking | 0.00 | Invention steel | | 34 | Cracking | 0.12 | Reference steel | Unsatisfactory grain size |
| 10 | No cracking | 0.00 | Invention steel | | 35 | Cracking | 0.17 | Reference steel | Unsatisfactory grain size |
| 11 | No cracking | 0.00 | Invention steel | | 36 | Cracking | 0.16 | Reference steel | Unsatisfactory grain size |
| 12 | No cracking | 0.00 | Invention steel | | 37 | Cracking | 0.03 | Reference steel | Unsatisfactory grain size |
| 13 | No cracking | 0.00 | Invention steel | | 38 | Cracking | 0.05 | Reference steel | Unsatisfactory grain size |
| 14 | No cracking | 0.00 | Invention steel | | 39 | Cracking | 0.01 | Reference steel | Unsatisfactory grain size |
| 15 | No cracking | 0.00 | Invention steel | | 40 | Cracking | 0.09 | Reference steel | Unsatisfactory grain size |
| 16 | No cracking | 0.00 | Invention steel | | 41 | Cracking | 0.55 | Reference steel | Unsatisfaction of grain size (Mn + Si + 20P) weight |
| 17 | No cracking | 0.00 | Invention steel | | 42 | Cracking | 0.12 | Reference steel | Unsatisfactory (Mn + Si + 20P) weight |
| 18 | No cracking | 0.00 | Invention steel | | 43 | Cracking | 0.33 | Reference steel | Unsatisfactory (Mn + Si + 20P) weight |
| 19 | No cracking | 0.00 | Invention steel | | 44 | Cracking | 0.43 | Reference steel | Unsatisfactory (Mn + Si + 20P) weight |
| 20 | No cracking | 0.00 | Invention steel | | 45 | Cracking | ≧1.50 | Reference steel | Unsatisfaction of Mn weight, grain size and (Mn + Si + 20P) weight |
| 21 | No cracking | 0.00 | Invention steel | | 46 | Cracking | ≧1.50 | Reference steel | Unsatisfaction of Mn weight and (Mn + Si + 20P) weight |
| 22 | No cracking | 0.00 | Invention steel | | 47 | Cracking | ≧1.50 | Reference steel | Unsatisfaction of Mn, Si, P weight, and grain size (Mn + Si + 20P) weight |
| 23 | No cracking | 0.00 | Invention steel | | 48 | Cracking | ≧1.50 | Reference steel | Unsatisfaction of Mn, Si, P weight, and (Mn + Si + 20P) weight |
| 24 | No cracking | 0.00 | Invention steel | | 49 | Cracking | 0.22 | Reference steel | Unsatisfaction of Mn weight |
| 25 | Cracking | 0.09 | Reference steel | Unsatisfactory grain size | 50 | Cracking | 0.40 | Reference steel | Unsatisfaction of Mn weight |

TABLE 3

| Test steel No. | Chemical component (Wt %): C | Si | Mn | P | S | Ni | Cr | Mo | V | Others | Si + Mn + 20P | Prior γ grain size | Resistane to stress corrosion cracking property (Maximum crack depth): Test I | Test II | Test III | Remarks |
|---|---|---|---|---|---|---|---|---|---|---|---|---|---|---|---|---|
| 51 | 0.23 | 0.09 | 0.58 | 0.009 | 0.003 | 3.75 | 1.69 | 0.36 | 0.09 | Nb:0.003, Ti:0.001 | 0.85 | 4 | 0.00 | 0.09 | 0.30 | |
| 52 | " | " | " | " | " | " | " | " | " | Nb:0.003, Ti:0.001 | " | 7 | 0.00 | 0.08 | 0.32 | |
| 53 | " | " | " | " | " | " | " | " | " | Nb:0.003, Ti:0.001 | " | 10 | 0.00 | 0.05 | — | |
| 54 | 0.24 | 0.08 | 0.58 | 0.005 | 0.004 | 3.50 | 1.65 | 0.39 | 0.10 | B:0.009 | 0.76 | 4 | 0.00 | 0.12 | — | |
| 55 | " | " | " | " | " | " | " | " | " | B:0.009 | " | 8 | 0.00 | 0.01 | — | |
| 56 | 0.20 | 0.10 | 0.57 | 0.005 | 0.001 | 3.64 | 1.75 | 0.35 | 0.11 | Sn:0.006 | 0.77 | 5 | 0.00 | 0.04 | — | |
| 57 | " | " | " | " | " | " | " | " | " | Sn:0.006 | " | 9 | 0.00 | 0.06 | — | |
| 58 | 0.06 | 0.10 | 0.31 | 0.006 | 0.005 | 3.49 | 1.70 | 0.38 | 0.10 | Nb:0.005 | 0.53 | −1 | 0.00 | 0.06 | 0.29 | |
| 59 | 0.20 | 0.07 | 0.32 | 0.007 | 0.004 | 3.58 | 1.72 | 0.39 | 0.01 | Ti:0.055, Al:0.020 | 0.53 | 3 | 0.00 | 0.00 | 0.34 | |
| 60 | 0.21 | 0.07 | 0.52 | 0.006 | 0.004 | 3.58 | 1.72 | 0.39 | 0.25 | Ti:0.003, Nb:0.010 | 0.71 | 2 | 0.00 | 0.07 | — | |
| 61 | 0.21 | 0.08 | 0.31 | 0.008 | 0.005 | 3.65 | 1.84 | 0.38 | 0.10 | B:0.002 | 0.55 | 2 | 0.00 | 0.02 | — | |
| 62 | 0.22 | 0.08 | 0.31 | 0.006 | 0.004 | 3.52 | 1.72 | 0.37 | 0.11 | Nb:0.001, Ti:0.005, B:0.012 | 0.51 | 1 | 0.00 | 0.04 | — | |
| 63 | 0.20 | 0.08 | 0.40 | 0.006 | 0.001 | 3.60 | 1.75 | 0.34 | 0.10 | Sn:0.004 | 0.60 | 0 | 0.00 | 0.07 | — | |
| 64 | 0.19 | 0.10 | 0.59 | 0.002 | 0.010 | 3.70 | 1,70 | 0.35 | 0.10 | Ce:0.20, | 0.73 | 3 | 0.00 | 0.11 | — | |
| 65 | 0.25 | 0.01 | 0.58 | 0.004 | 0.008 | 3.58 | 1.69 | 0.35 | 0.09 | W:0.015 W:0.006, Al:0.05 | 0.75 | 3 | 0.00 | 0.08 | — | |
| 66 | 0.06 | 0.10 | 0.31 | 0.006 | 0.005 | 3.49 | 1.70 | 0.38 | 0.10 | Nb:0.005 | 0.53 | 4 | 0.00 | 0.00 | 0.12 | Same steel with No. 58 steel |
| 67 | 0.20 | 0.07 | 0.32 | 0.007 | 0.004 | 3.58 | 1.72 | 0.39 | 0.09 | Ti:0.055, Al:0.020 | 0.53 | 4 | 0.00 | 0.00 | 0.09 | Same steel with No. 59 steel |

TABLE 3-continued

| Test steel No. | Chemical component (Wt %) C | Si | Mn | P | S | Ni | Cr | Mo | V | Others | Si + Mn + 20P | Prior γ grain size | Resistane to stress corrosion cracking property (Maximum crack depth) Test I | Test II | Test III | Remarks |
|---|---|---|---|---|---|---|---|---|---|---|---|---|---|---|---|---|
| 68 | 0.21 | 0.07 | 0.52 | 0.006 | 0.004 | 3.58 | 1.72 | 0.39 | 0.25 | Ti:0.003, Nb:0.010 | 0.71 | 5 | 0.00 | 0.00 | 0.01 | Same steel with No. 60 steel |
| 69 | 0.21 | 0.08 | 0.31 | 0.008 | 0.005 | 3.65 | 1.84 | 0.38 | 0.10 | B:0.002 | 0.55 | 8 | 0.00 | 0.00 | 0.00 | Same steel with No. 61 steel |
| 70 | 0.22 | 0.08 | 0.31 | 0.006 | 0.004 | 3.52 | 1.72 | 0.37 | 0.11 | Nb:0.001, Ti:0.005, B:0.012 | 0.51 | 4 | 0.00 | 0.00 | 0.04 | Same steel with No. 62 steel |
| 71 | 0.20 | 0.08 | 0.40 | 0.006 | 0.001 | 3.60 | 1.75 | 0.34 | 0.10 | Sn:0.004 | 0.60 | 7 | 0.00 | 0.00 | 0.06 | Same steel with No. 63 steel |
| 72 | 0.19 | 0.10 | 0.59 | 0.002 | 0.010 | 3.70 | 1.70 | 0.35 | 0.10 | Ce:0.20, W:0.015 | 0.73 | 6 | 0.00 | 0.00 | 0.11 | Same steel with No.64 steel |
| 73 | 0.25 | 0.09 | 0.58 | 0.004 | 0.008 | 3.58 | 1.69 | 0.35 | 0.09 | W:0.006, Al:0.05 | 0.75 | 4 | 0.00 | 0.00 | 0.10 | Same steel with No. 65 steel |
| 74 | " | " | " | " | " | " | " | " | " | W:0.006, Al:0.05 | " | 7 | 0.00 | 0.00 | 0.02 | Same steel with No. 65 steel |
| 75 | 0.20 | 0.01 | 0.31 | 0.005 | 0.004 | 3.48 | 1.72 | 0.38 | 0.10 | Nb:0.005 | 0.42 | 2 | 0.00 | 0.00 | 0.06 | |
| 76 | 0.22 | 0.08 | 0.32 | 0.001 | 0.005 | 3.50 | 1.73 | 0.32 | 0.10 | Ti:0.002 | 0.42 | 3 | 0.00 | 0.00 | 0.08 | |
| 77 | 0.22 | 0.03 | 0.32 | 0.003 | 0.006 | 3.65 | 1.26 | 0.34 | 0.10 | Sn:0.005 | 0.41 | 3 | 0.00 | 0.00 | 0.09 | |
| 78 | 0.18 | 0.04 | 0.30 | 0.003 | 0.004 | 3.54 | 1.71 | 0.38 | — | B:0.005, W:0.010 | 0.40 | 3 | 0.00 | 0.00 | 0.06 | |
| 79 | 0.21 | 0.08 | 0.31 | 0.005 | 0.004 | 3.53 | 1.72 | 0.38 | 0.10 | Nb:0.054, Ce:0.015 | 0.49 | −1 | 0.00 | 0.00 | 0.13 | |
| 80 | 0.20 | 0.06 | 0.31 | 0.004 | 0.005 | 3.53 | 1.72 | 0.38 | 0.10 | Al:0.009 | 0.45 | 1 | 0.00 | 0.00 | 0.14 | |
| 81 | 0.20 | 0.02 | 0.20 | 0.002 | 0.005 | 3.50 | 1.69 | 0.35 | 0.12 | W:0.050, Ce:0.015 | 0.26 | 0 | 0.00 | — | 0.02 | |
| 82 | 0.23 | 0.02 | 0.29 | 0.002 | 0.002 | 3.62 | 1.68 | 0.34 | 0.10 | Nb:0.032 | 0.35 | −2 | 0.00 | — | 0.06 | |
| 83 | " | " | " | " | " | " | " | " | " | Nb:0.032 | " | 1 | 0.00 | 0.00 | 0.07 | |
| 84 | " | " | " | " | " | " | " | " | " | Nb:0.032 | " | 3 | 0.00 | — | 0.03 | |
| 85 | 0.20 | 0.01 | 0.31 | 0.005 | 0.004 | 3.48 | 1.72 | 0.38 | 0.10 | Nb:0.005 | 0.42 | 4 | 0.00 | 0.00 | 0.00 | Same steel with No. 75 steel |
| 86 | 0.22 | 0.08 | 0.32 | 0.001 | 0.005 | 3.50 | 1.73 | 0.32 | 0.10 | Ti:0.002 | 0.42 | 6 | 0.00 | 0.00 | 0.00 | Same steel with No. 76 steel |
| 87 | 0.22 | 0.03 | 0.32 | 0.003 | 0.006 | 3.65 | 1.26 | 0.34 | 0.10 | Sn:0.005 | 0.41 | 5 | 0.00 | 0.00 | 0.00 | Same steel with No. 77 steel |
| 88 | 0.18 | 0.04 | 0.30 | 0.003 | 0.004 | 3.54 | 1.71 | 0.38 | — | B:0.005, W:0.010 | 0.40 | 4 | 0.00 | — | 0.00 | Same steel with No. 78 steel |
| 89 | 0.21 | 0.08 | 0.31 | 0.005 | 0.004 | 3.53 | 1.72 | 0.38 | 0.10 | Nb:0.054, Ce:0.015 | 0.49 | 4 | 0.00 | — | 0.00 | Same steel with No. 79 steel |
| 90 | 0.20 | 0.06 | 0.31 | 0.004 | 0.005 | 3.53 | 1.69 | 0.38 | 0.10 | A:0.009 | 0.45 | 10 | 0.00 | — | 0.00 | Same steel with No. 80 steel |
| 91 | 0.20 | 0.02 | 0.20 | 0.002 | 0.005 | 3.50 | 1.69 | 0.35 | 0.12 | W:0.050, Ce:0.015 | 0.26 | 4 | 0.00 | — | 0.00 | Same steel with No. 81 steel |
| 92 | 0.23 | 0.02 | 0.29 | 0.002 | 0.002 | 3.62 | 1.68 | 0.34 | 0.10 | Nb:0.032 | 0.35 | 4 | 0.00 | — | 0.00 | Same steel with No. 82 steel |
| 93 | " | " | " | " | " | " | " | " | " | Nb:0.032 | " | 7 | 0.00 | — | 0.00 | Same steel with No. 82 steel |
| 94 | " | " | " | " | " | " | " | " | " | Nb:0.032 | " | 9 | 0.00 | — | 0.00 | Same steel with No. 82 steel |
| 95 | 0.23 | 0.09 | 0.58 | 0.009 | 0.003 | 3.75 | 1.69 | 0.36 | 0.09 | Nb:0.003, Ti:0.001 | 0.85 | 3 | 0.29 | 1.20 | ≧1.50 | Same steel with No. 51~53 steel |
| 96 | 0.24 | 0.08 | 0.58 | 0.005 | 0.004 | 3.50 | 1.65 | 0.39 | 0.10 | B:0.009 | 0.76 | 3 | 0.16 | 0.85 | ≧1.50 | Same steel with No. 54~55 steel |
| 97 | " | " | " | " | " | " | " | " | " | B:0.009 | " | 1 | 0.16 | 0.35 | ≧1.50 | Same steel with No. 54~55 steel |
| 98 | " | " | " | " | " | " | " | " | " | B:0.009 | " | −1 | 0.95 | ≧1.50 | ≧1.50 | Same steel with No. 54~55 steel |
| 99 | 0.20 | 0.10 | 0.57 | 0.005 | 0.001 | 3.64 | 1.75 | 0.35 | 0.11 | Sn:0.006 | 0.77 | 3 | 0.23 | 0.84 | ≧1.50 | Same steel with No. 56~57 steel |
| 100 | " | " | " | " | " | " | " | " | " | Sn:0.006 | " | 0 | 0.45 | 0.76 | ≧1.50 | Same steel with No. 56~57 steel |
| 101 | 0.20 | 0.14 | 0.58 | 0.002 | 0.001 | 3.48 | 1.70 | 0.33 | 0.10 | Nb:0.004, Ti:0.001 | 0.76 | 1 | 0.32 | — | ≧1.50 | |
| 102 | 0.19 | 0.10 | 0.55 | 0.007 | 0.003 | 3.60 | 1.74 | 0.35 | 0.11 | Sn:0.007 | 0.79 | 0 | 0.18 | — | ≧1.50 | |
| 103 | 0.22 | 0.18 | 0.59 | 0.010 | 0.009 | 3.50 | 1.80 | 0.35 | 0.10 | Al:0.015, W:0.009 | 0.97 | 0 | 0.60 | — | — | |
| 104 | " | " | " | " | " | " | " | " | " | W:0.009 | " | 3 | 0.45 | — | — | |
| 105 | 0.25 | 0.12 | 0.31 | 0.006 | 0.005 | 3.48 | 1.73 | 0.37 | 0.10 | — | 0.55 | 6 | 1.30 | — | — | |
| 106 | 0.20 | 0.17 | 0.30 | 0.008 | 0.004 | 3.50 | 1.72 | 0.38 | 0.10 | — | 0.63 | 4 | ≧1.50 | ≧1.50 | ≧1.50 | |
| 107 | 0.22 | 0.13 | 0.80 | 0.008 | 0.004 | 3.53 | 1.73 | 0.38 | 0.11 | — | 1.09 | 3 | ≧1.50 | ≧1.50 | ≧1.50 | |
| 108 | 0.21 | 0.10 | 0.32 | 0.012 | 0.004 | 3.53 | 1.72 | 0.36 | 0.10 | — | 0.66 | −1 | 1.30 | ≧1.50 | — | |
| 109 | 0.19 | 0.08 | 0.32 | 0.001 | 0.005 | 3.60 | 1.69 | 0.35 | 0.09 | — | 0.42 | 5 | 0.92 | ≧1.50 | — | |

*Test I: 4 points bending, 150° C., 30% NaoH, immerged for 1 week, Load stress = 0.6 $\sigma y$
Test II: 4 points bending, 150° C., 30% NaoH, immerged for 1 week, Load stress = 1.0 $\sigma y$
Test III: 4 points bending, 150° C., 30% NaoH, immerged for 3 weeks, Load stress = 1.0 $\sigma y$

What is claimed is:

(i) At least one of Al, Ti, Nb, W, B or Ce: 0.001 to 0.50% in total (ii) Sn: 0.003 to 0.015% the remainder being Fe and unavoidable impurities, the austenite crystal grain size thereof being in excess of 4 of ASTM crystal grain size number.

2. A low alloy austenitic steel having good stress corrosion craking resistance consisting essentially of c:≦0.40%, Si:≦0.15%, Mn:≦0.60%, P:≦0.010%, Si:≦0.030%, Ni: 0.50 to 4.00%, Cr: 0.50 to 2.50%, Mo: 0.25 to 4.00% and V:≦0.30% and further containing at least one element selected from the following (i) and (ii) groups consisting of:

(i) At least one of Al, Ti, Nb, W, B or Ce: 0.001 to 0.50% in total (ii) Sn: 0.003 to 0.015% said Si, Mn and P being fulfilled with the relationship of Si+Mn+20P≦0.75%, the remainder being Fe and unavoidable impurities, the austenite crystal grain size thereof being in excess of 4 of ASTM crystal grain size number.

* * * * *